US011545768B2

(12) United States Patent
King

(10) Patent No.: US 11,545,768 B2
(45) Date of Patent: Jan. 3, 2023

(54) RETAINING RING TERMINAL

(71) Applicant: FEW Automotive Glass Applications, Inc., Wooster, OH (US)

(72) Inventor: Jesse King, Wooster, OH (US)

(73) Assignee: FEW FAHRZEUGELEKTRIK WERK GMBH & CO. KG

( * ) Notice: Subject to any disclaimer, the term of this patent is extended or adjusted under 35 U.S.C. 154(b) by 0 days.

(21) Appl. No.: 17/241,474

(22) Filed: Apr. 27, 2021

(65) Prior Publication Data

US 2021/0249799 A1 Aug. 12, 2021

Related U.S. Application Data

(63) Continuation of application No. 16/723,461, filed on Dec. 20, 2019, now Pat. No. 11,031,707.

(60) Provisional application No. 62/797,066, filed on Jan. 25, 2019.

(51) Int. Cl.
*H01R 11/12* (2006.01)
*H01R 4/18* (2006.01)

(52) U.S. Cl.
CPC ..... *H01R 11/12* (2013.01); *H01R 4/185* (2013.01)

(58) Field of Classification Search
None
See application file for complete search history.

(56) References Cited

U.S. PATENT DOCUMENTS

| | | | |
|---|---|---|---|
| 2,404,176 | A | 7/1943 | Huelster |
| 3,569,919 | A | 3/1971 | Daddona, Jr. |
| 6,027,356 | A | 2/2000 | Wright |
| 6,520,812 | B1 | 2/2003 | Machado |
| 6,607,409 | B2 | 8/2003 | Machado |
| 6,676,455 | B2 | 1/2004 | Machado |
| 6,790,104 | B2 | 9/2004 | Antaya et al. |
| 7,252,564 | B1 | 8/2007 | Morello et al. |
| 7,296,347 | B2 | 11/2007 | Antaya et al. |
| 7,789,720 | B2 | 9/2010 | Zinn |
| 8,382,531 | B2 | 2/2013 | Astola |
| 8,496,503 | B2 | 7/2013 | Lamoureux et al. |
| 9,153,880 | B2 | 10/2015 | Omori et al. |
| 9,466,908 | B2 | 10/2016 | Ohkubo et al. |
| 9,793,627 | B2 | 10/2017 | Omori et al. |
| 9,825,378 | B2 | 11/2017 | Konig |
| 9,979,098 | B2 | 5/2018 | Lyon et al. |

(Continued)

*Primary Examiner* — Ross N Gushi
(74) *Attorney, Agent, or Firm* — Emerson, Thomson & Bennett, LLC; Roger D. Emerson; Peter R. Detorre

(57) ABSTRACT

Provided is a female electrical connector referred to as a retaining ring terminal. The retaining ring terminal is a one-piece electrical connector having a crimp style cable connector portion on one end for receiving an electrical cable and a female post connector portion on a second end for receiving a post or male electrical connector. The female post connector portion includes a flat planar ring and a plurality of tabs (separated by a plurality of grooves) which extend from the inner surface of the flat planar ring inwardly towards the opening of the female post connector portion. The female post connector portion also includes a groove which extends through a flat planar ring, referred to as a ring groove which becomes a tab groove and has the same shape as the other tab grooves. A pair of ring holes are positioned on opposite sides of the ring groove on the flat planar ring.

20 Claims, 5 Drawing Sheets

(56) References Cited

U.S. PATENT DOCUMENTS

| | | | | |
|---|---|---|---|---|
| 10,050,358 | B2 | 8/2018 | Muller et al. | |
| 11,031,707 | B2 * | 6/2021 | King | H01R 4/185 |

* cited by examiner

RETAINING RING TERMINAL

I. BACKGROUND

A. Field of the Invention

The present disclosure generally concerns apparatuses and methods related to electrical connectors.

B. Description of Related Art

Many types and sizes of electrical connectors are used in various industries. One type of electrical connector is called a female connector because it electrically connects to a male connector or post. While many known electrical connectors work well for their intended purpose, improvements are desirable.

II. SUMMARY

Provided is a retaining ring terminal. The retaining ring terminal includes a one-piece electrical connector having a crimp style cable connector portion and a female post connector portion wherein the post connector portion includes a planer ring and inner tabs that receives a post or male electrical connector; wherein the planar ring has an inner circumference and an outer circumference, wherein the inner tabs are positioned along an inner circumference of the planar ring and are angled at a height from the planar ring; wherein the inner tabs that receive the post extend inwardly, are symmetrically positioned and all have the same size and shape; wherein the inner tabs along the inner circumference of the planar ring form an opening having a diameter ranging from a first inner tab edge surface on a first inner tab to a second inner tab edge surface on a second inner tab opposite the first inner tab and having a corresponding radius half the distance of the diameter; wherein the female post connector portion has a low profile opening in that the ratio of the height of the inner tabs with respect to the planar ring to the radius of the opening of the inner tabs is 0.6; wherein the planar ring further comprises a ring groove that extends through the planar ring into the opening, wherein the ring groove forms a tab groove as a tab groove portion of the ring groove extends towards the opening and wherein the tab groove portion of the ring groove has the same height, angle and width as the other inner tab grooves with respect to the planar ring; and wherein the planar ring further comprises a first end and a second end adjacent to the ring groove, wherein the first end of the planar ring and the second end of the planar ring comprises a ring hole.

According to certain aspects of the present teaching, the inner tabs of the retaining ring terminal are curved to extend upwardly from the planar ring.

According to further aspects of the present teaching, a tab groove is positioned between each inner tab.

According to further aspects of the present teaching, the inner tabs have a width which narrows as it extends inwardly.

According to further aspects of the present teaching, all of the inner tabs and tab grooves have the same size and shape.

According to further aspects of the present teaching, the retaining ring terminal includes eight inner tabs.

According to further aspects of the present teaching, the female post connector portion is connected to the cable connector portion by a first bridge portion.

According to further aspects of the present teaching, the cable connector portion comprises one or more sets of flanges which can be crimped to electrically connect the retaining ring terminal to the cable.

According to further aspects of the present teaching, the cable connector portion includes a first flange set, a second flange set and a second flange bridge portion connecting the first flange set to the second flange set, wherein the first flange set and the second flange set comprise an inner surface, an outer surface, a first flange end, a second flange end and wherein the second flange set includes an end surface edge forming a first end of the retaining ring terminal.

According to further aspects of the present teaching, the first flange end of the first and second flange sets each include a first flange edge surface, wherein the second flange end of the first and second flange sets each include a second flange edge surface and wherein the first flange edge surface and the second flange edge surface come into contact with each other when the first and second flange sets are crimped together.

According to further aspects of the present teaching, the first flange set has a length which is greater than the length of the second flange set when the first flange set and the second flange set are in an opened state and wherein the second flange set has a width which is greater than the first flange set when the first flange set and the second flange set are in an opened state.

According to further aspects of the present teaching, the first flange set is adjacent to the first bridge portion connecting the female post connector portion.

According to further aspects of the present teaching, the second flange set is adjacent to the second flange bridge portion connecting the first flange set.

According to further aspects of the present teaching, the second flange bridge portion comprises a first end proximate to the first flange set and a second end proximate to the second flange set, wherein the first end of the second flange bridge portion has a width that is less than that of the second end of the second flange bridge portion when in an opened state.

According to further aspects of the present teaching, the ratio of the length of the retaining ring terminal to the combined length of the first flange set, second flange set and second flange bridge portion is not more than 3.5:1 or about 3.5:1.

According to further aspects of the present teaching, the ratio of the length of the retaining ring terminal to the first flange set is not more than 6:1 or about 6:1.

According to further aspects of the present teaching, the ratio of the length of the retaining ring terminal to the second flange set is at least 10:1 or about 10:1.

According to further aspects of the present teaching, the retaining ring terminal is formed of a pre-tinned-510 phosphor bronze alloy.

According to further aspects of the present teaching, the first flange set includes one or more ribs along its inner and outer surface.

According to further aspects of the present teaching, the ratio of the diameter of the retaining ring to the diameter of the opening is from about 2.6 but not more than 3.1.

III. BRIEF DESCRIPTION OF THE DRAWINGS

The retaining ring terminal disclosed herein may take physical form in certain parts and arrangement of parts, embodiments of which will be described in detail in this specification and illustrated in the accompanying drawings which form a part hereof and wherein.

III. DETAILED DESCRIPTION

Figure 1:
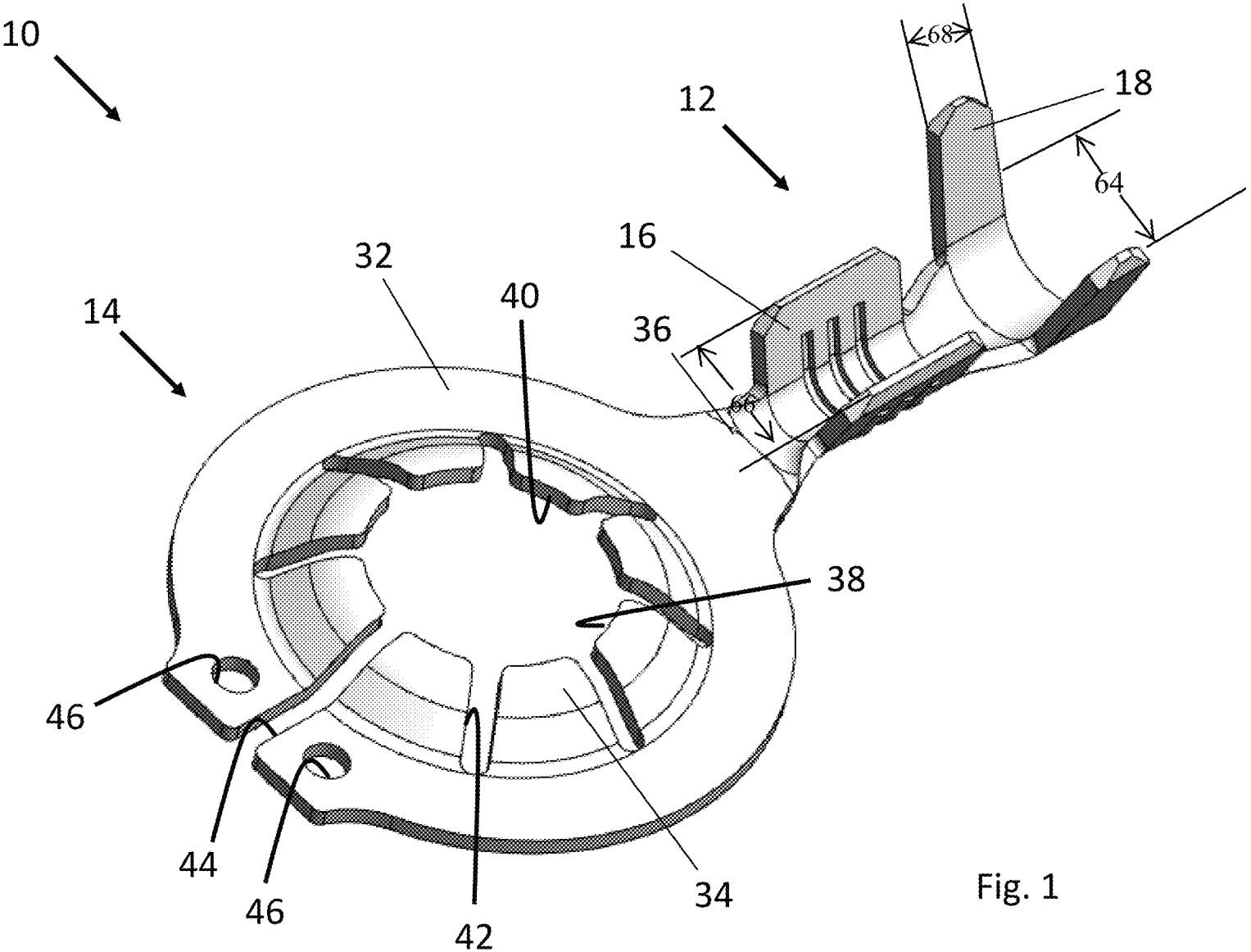
FIG. 1 is a perspective top view of an exemplary embodiment of the retaining ring terminal.
Figure 2:
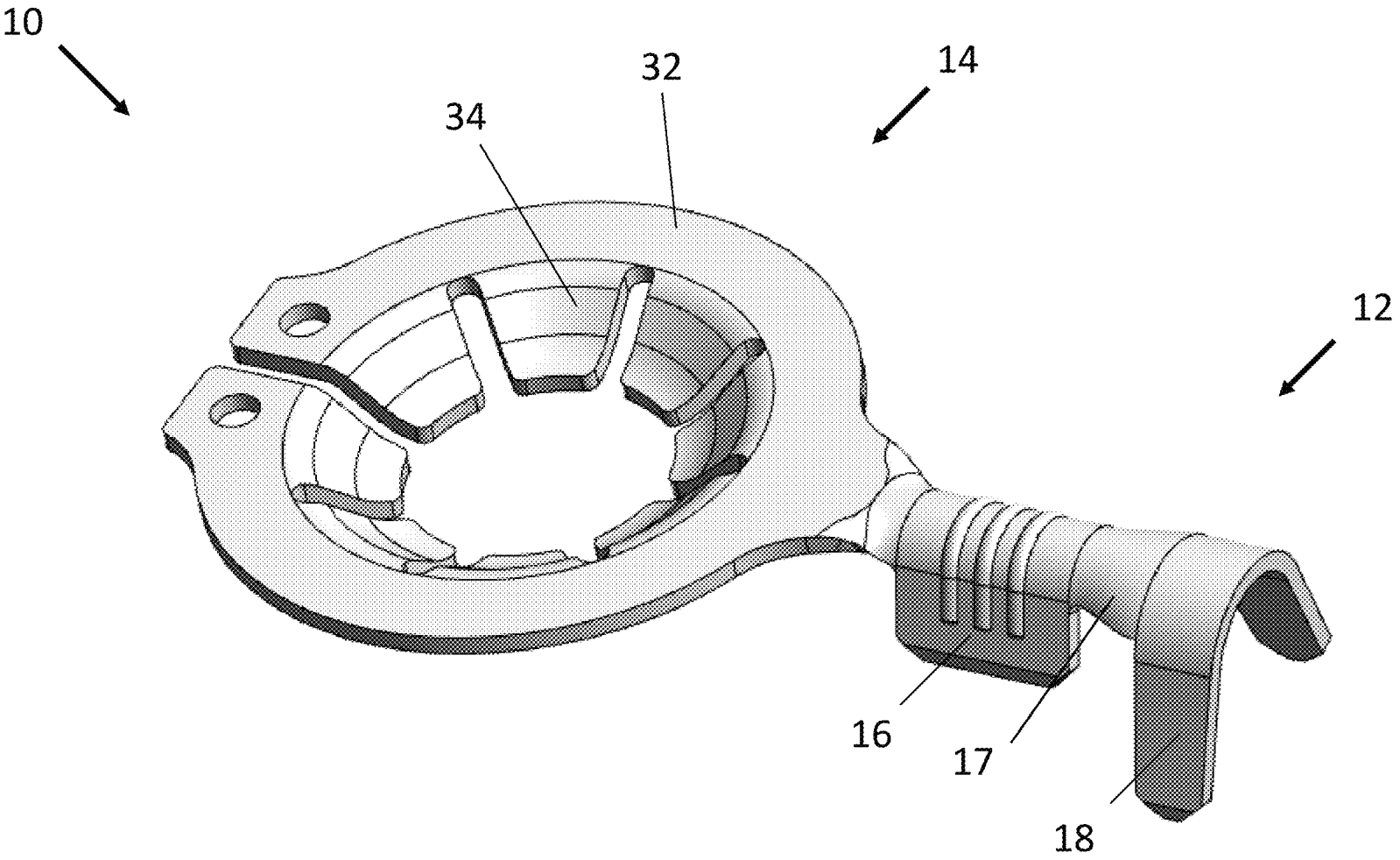
FIG. 2 is a perspective top view of an exemplary embodiment of the retaining ring terminal.

Referring now to the drawings wherein the showings are for purposes of illustrating embodiments of the invention only and not for purposes of limiting the same, and wherein like reference numerals are understood to refer to like components, FIGS. 1 and 2 illustrate a retaining ring terminal 10 according to some embodiments of the present disclosure. The retaining ring terminal 10 may be a female electrical connector, as shown. The retaining ring terminal 10 may have a cable connector portion 12 used to connect the retaining ring terminal 10 to a cable (not shown) and a post connector portion 14 (also referred to herein as a "female post connector portion") used to connect the retaining ring terminal 10 to a post or male electrical connector (not shown).

Figure 3:
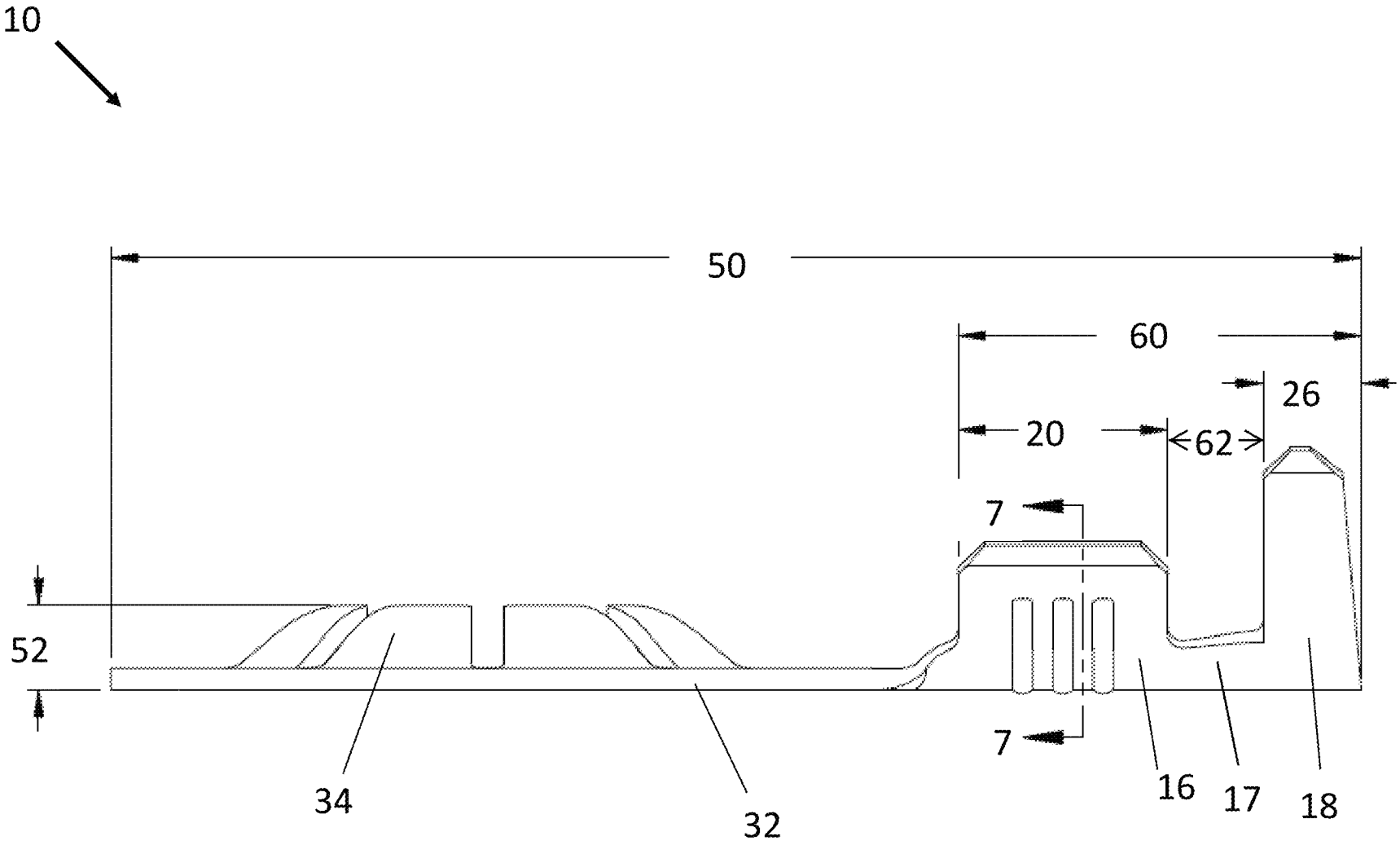
FIG. 3 is a side view of an exemplary embodiment of the retaining ring terminal.
Figure 7:
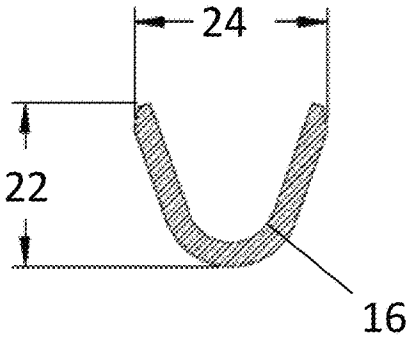
FIG. 7 is a sectional view taken along line 7-7 in FIG. 3.
Figure 5:
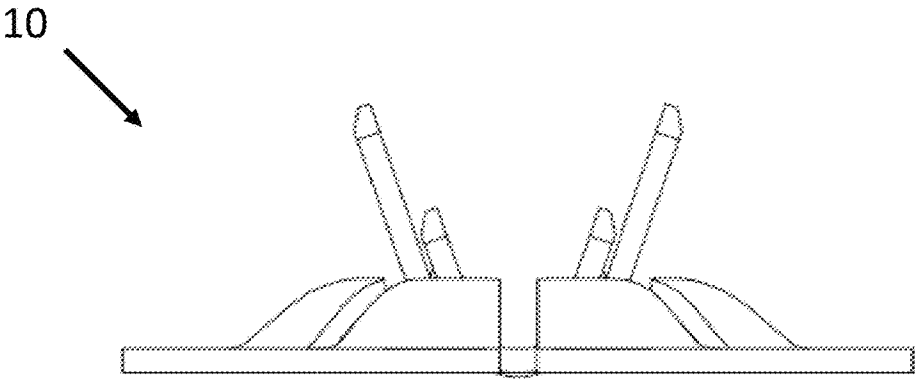
FIG. 5 is an end view of an exemplary embodiment of the retaining ring terminal.
Figure 6:
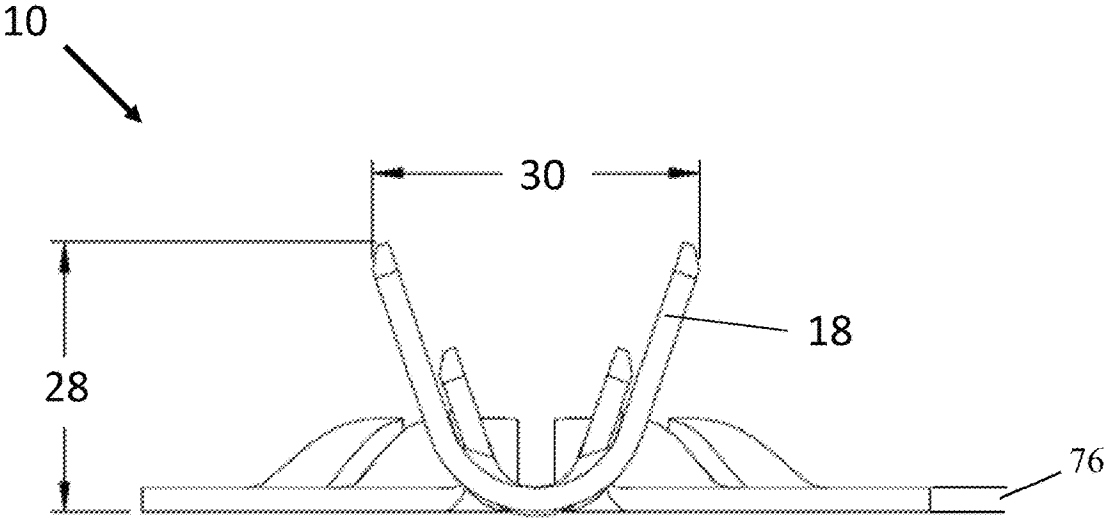
FIG. 6 is an opposite end view of an exemplary embodiment of the retaining ring terminal.

The cable connector portion 12 may include one or more sets of flanges (two such flange sets shown as 16 and 18) which can be crimped in a known manner to electrically connect the retaining ring terminal 10 to the cable. First flange set 16 may have a length 20 as shown in FIG. 3 and a height 22 and width 24 as shown in FIG. 7. Second flange set 18 may have a length 26 as shown in FIG. 3 and a height 28 and width 30 as shown in FIG. 6. The first flange set and the second flange set may be connected together by a second flange bridge portion 17. The second flange bridge portion 17 includes a first end proximate to the first flange set 16 and a second end proximate to the second flange set 18. In certain embodiments, the first end of the flange bridge portion has a width that is less than that of the second end of the flange bridge portion when in an opened state. In such embodiments, the second end of the second flange bridge portion 17 may receive an insulated electrical wire that is stripped at one end so that the stripped portion of the electrical wire is received within the first flange set 16 and the insulated portion of the electrical wire is received and rests within the second flange bridge portion 17. The flange sets together, from end to end, may have a combined length 60 as shown in FIG. 3. The first flange set 16 and second flange set 18 include an inner surface and an outer surface. The inner surface is predominantly visible when the first and second flange set is in an opened state as shown within FIG. 4 and the outer surface is predominantly visible in FIG. 2 which shows the first and second flange set in at least a partially closed state. The second flange set includes an end surface edge which forms a first end of the retaining ring terminal. A second or opposite end of the retaining ring terminal is formed by an end surface edge of a ring groove 44 as described below. The first flange set and the second flange set each include a first flange end and a second flange end. The first flange end and the second flange end of the first and second flange sets each include a first flange edge surface and a second flange edge surface which are capable of contacting each other when the first and second flange sets are crimped together.

With reference now to FIGS. 1 and 2, the post-connection portion 14 may have a ring 32 (also referred to herein as a "planar ring") with multiple tabs 34 (also referred to herein as "inner tabs") extending inwardly from the ring 32 along the inner circumference of the ring. The tabs 34 form an opening having a diameter ranging from a first inner tab edge surface on a first inner tab to a second inner tab edge surface on a second inner tab opposite the first inner tab. The ring 32 may be generally planar, as shown, and may be connected to the cable connector portion 12 via bridge portion 36. In this way, the retaining ring terminal 10 is a one-piece component (also referred to herein as a "one-piece electrical connector"). The tabs 34 may be curved to extend upwardly from the ring 32 and have inner surfaces 38 (also referred to herein as "inner edge surfaces") that define opening 40 that receives the male post (not shown). The extension of the tabs 34 upwardly may be at a certain angle with respect to the planar ring 32. For example, the tabs 34 may extend upwardly at an angle of 40° or about 40° from the planar ring 32, however, in other embodiments, the tabs 34 may extend upwardly at an angle ranging from about 20° to about 60°. A tab groove 42 may be positioned between each tab 34. The widths of the tabs 34 may narrow as they extend inwardly, as shown. In some embodiments all the tabs 34 and tab grooves 42 may have the same size and shape, as is shown. In one specific embodiment there may be eight tabs 34 as shown. A ring groove 44 may extend through the ring 32 and into the opening 40. According to certain aspects of the present teaching, the ring groove 44 includes a tab groove portion and forms a tab groove as the tab groove portion extends into the opening. The ring groove 44 enables the ring to flex enabling the post connector portion 14 to easily be attached to and removed from the post. In one embodiment the ring groove 44 communicates with a tab groove 42, as shown. In yet another embodiment the ring groove has the same height, angle and width 48 as the tab grooves 42 (see FIG. 4). A pair of holes 46, 46 may be positioned on the ring 32 on opposite sides of the ring groove 44, as shown. The pair of holes 46 may be configured to receive a tool such as a pincer which allows for the ring 32 to be opened as it is fitted around or removed from the post or male connector (not shown).

Figure 4:
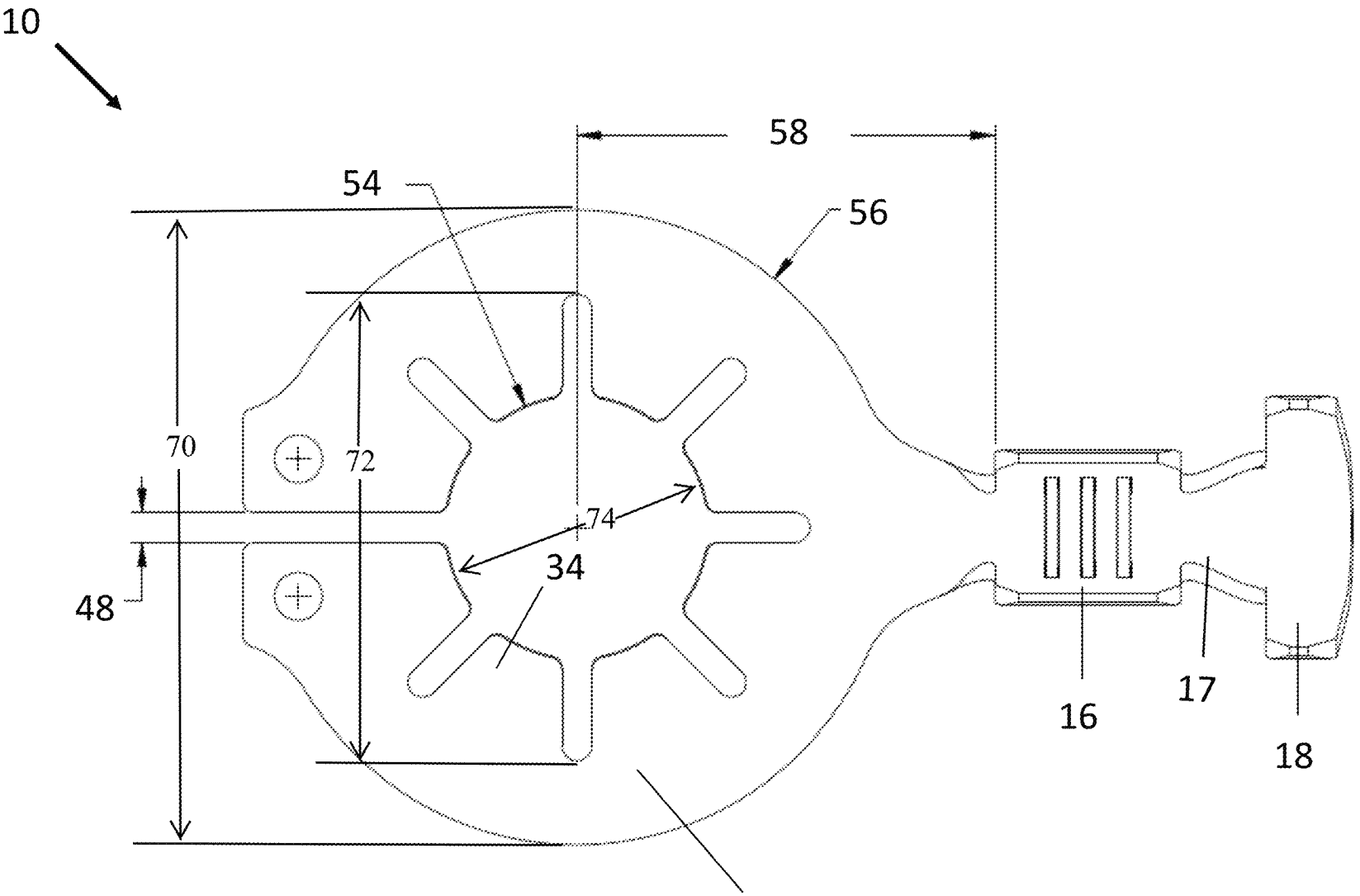
FIG. 4 is a top view of an exemplary embodiment of the retaining ring terminal.

As shown in FIG. 3, the retaining ring terminal 10 may have a length 50 and the tabs 34 may have a maximum height 52 with respect to the planar ring 32. The planar ring 32 also includes an inner circumference and an outer circumference with the tabs 34 positioned along the inner circumference of the ring and angled at a height from the ring 32. As shown in FIG. 4, the opening 40 may have a diameter 54 and the ring 32 may have an outside diameter 56. Distance 58 is between the center of the opening 40 and the nearest edge of the flange set 16. While the retaining ring terminal 10 may have any dimensions chosen with the purview of a person of ordinary skill in the art, in one embodiment the dimensions of the retaining ring terminal are as follows:

TABLE 1

| Dimensions of Retaining Ring Terminal | | |
|---|---|---|
| Reference Number | Customary System Measurement (inches) | Metric System (millimeters) |
| 20 | 0.156 | 3.9624 |
| 22 | 0.110 | 2.794 |
| 24 | 0.130 | 3.302 |
| 26 | 0.073 | 1.8542 |
| 28 | 0.180 | 4.572/4.8 |
| 30 | 0.220 | 5.588/5.7 |
| 48 | 0.025 | 0.635 |
| 50 | 0.930 | 23.622 |
| 52 | 0.063 | 1.6002 |
| 54 | 0.219 | 5.5626 |
| 56 | 0.531 | 13.4874 |
| 58 | 0.350 | 8.89 |
| 60 | 0.300 | 7.62 |
| 62 | 0.071 | 1.8034 |
| 64 | 0.191 | 4.85 |
| 66 | 0.152 | 3.85 |
| 68 | 0.069 | 1.75 |
| 70 | 0.535 | 13.6 |
| 72 | 0.388 | 9.85 |
| 74 | 0.203 | 5.15 |
| 76 | 0.026 | 0.65 |

* All dimensions have a tolerance of +/−0.0079 in. or +/−0.2 mm.

As shown in FIGS. 1-3, the female post connector portion may have a low profile opening. By low profile opening, it is meant that the ratio of the height of the inner tabs 34 with respect to the ring 32 is relatively low. According to certain aspects of the present teaching, the ratio of the height of the inner tabs 34 with respect to the ring 32 is 0.6 or about 0.6. According to further aspects of the present teaching, the ratio of the height of the inner tabs 34 with respect to the ring is at least 0.5 or at least 0.6. According to further aspects of the present teaching, the ratio of the height of the inner tabs 34 with respect to the ring 32 is from about 0.5 to about 1.5.

As shown in FIG. 3, the retaining ring terminal 10 has an overall length 50, a portion of which includes a combined length 48 of the first flange set, the second flange set and the second flange bridge portion. Length 50 and length 48 may be in proportion to each other. According to certain aspects of the present teaching, the ratio of the length of the retaining ring terminal 50 to the combined length of the first flange set, second flange set and flange bridge portion 48 is 3:1 or about 3:1. According to further aspects of the present teaching, the ratio of the length of the retaining ring terminal 50 to the combined length of the first flange set, second flange set and flange bridge portion 48 is not more than 3:1 or about 3:1, not more than 3.1:1 or about 3.1:1, not more than 3.2:1 or about 3.2:1, not more than 3.3:1 or about 3.3:1, not more than 3.4:1 or about 3.4:1, or not more than 3.5:1 or about 3.5:1. According to further aspects of the present teaching, the ratio of the length of the retaining ring terminal 50 to the combined length of the first flange set, second flange set and flange bridge portion 48 is not more than 2.5:1 or about 2.5:1.

According to certain aspects of the present teaching, the first flange set 16 has a length which is greater than the length of the second flange set 18 when the first flange set 16 and the second flange set are in an opened state as shown in FIG. 4.

As shown in FIG. 3, the first flange set may have a length 20 in proportion to the overall length 50 of the retaining ring terminal. According to certain aspects of the present teaching, the ratio of the length of the retaining ring terminal 50 to the length of the first flange set 20 is 5.96:1 or about 5.96:1. According to further aspects of the present teaching, the ratio of the length of the retaining ring terminal 50 to the length of the first flange set 20 is 6:1 or about 6:1. According to further aspects of the present teaching, the ratio of the length of the retaining ring terminal 50 to the length of the first flange set 20 is not more than 5:1 or about 5:1, not more than 5.5:1 or about 5.5:1, or not more than 6:1 or about 6:1.

As shown in FIG. 3, the second flange set may have a length 26 in proportion to the overall length 50 of the retaining ring terminal. According to certain aspects of the present teaching, the ratio of the length of the retaining ring terminal 50 to the length of the second flange set 26 is 12.74:1 or about 12.74:1. According to further aspects of the present teaching, the ratio of the length of the retaining ring terminal 50 to the length of the second flange set 26 is 12.75:1 or about 12.75:1. According to further aspects of the present teaching, the ratio of the length of the retaining ring terminal 50 to the length of the second flange set 26 is at least 10:1 or about 10:1, at least 11:1 or about 11:1, at least 12:1 or about 12:1, at least 12.5:1 or about 12.5:1, at least 12.7:1 or about 12.7:1, at least 12.75:1 or about 12.75:1, at least 12.8:1 or about 12.8:1, at least 12.9:1 or about 12.9:1, or at least 13:1 or about 13:1.

According to certain aspects of the present teaching, the ratio of the width between the second flange set to the first flange set is 1.25 or about 1.25. According to further aspects of the present teaching, the ratio of the width between the second flange set to the first flange set is from 1.0 or about 1.0 to 1.75 or about 1.75.

According to certain aspects of the present teaching, the ratio of the diameter of the ring 32 to the opening 40 is 2.64 or about 2.64. According to further aspects of the present teaching, the ratio of the diameter of the ring 32 to the opening 40 is at least 2.6, at least 2.7, at least 2.8 or about 2.8, at least 2.9 or about 2.9, at least 3.0 or about 3.0 but not more than 3.1.

The retaining ring terminal 10 may be formed from an alloy. According to certain aspects of the present teaching, the retaining ring terminal 10 is formed of a pre-tinned C-510 phosphor bronze alloy.

Numerous embodiments have been described herein. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof. Further, the "invention" as that term is used in this document is what is claimed in the claims of this document. The right to claim elements and/or sub-combinations that are disclosed herein as other inventions in other patent documents is hereby unconditionally reserved.

I claim:

1. A method of making a retaining ring terminal comprising:

providing an alloy;

forming the retaining ring terminal from the alloy, wherein the retaining ring-terminal comprises— a one-piece electrical connector having a crimp style cable connector portion and a female post connector portion wherein the post connector portion includes a planer ring and inner tabs that receives a post or male electrical connector;

wherein the planar ring has an inner circumference and an outer circumference, wherein the inner tabs are positioned along an inner circumference of the planar ring and are angled at a height from the planar ring;

wherein the inner tabs that receive the post extend inwardly, are symmetrically positioned and all have the same size and shape;

wherein the inner tabs along the inner circumference of the planar ring form an opening having a diameter ranging from a first inner tab edge surface on a first inner tab to a second inner tab edge surface on a second inner tab opposite the first inner tab and having a corresponding radius half the distance of the diameter;

wherein the female post connector portion has a low profile opening in that the ratio of the height of the inner tabs with respect to the planar ring to the radius of the opening of the inner tabs is 0.6;

wherein the planar ring further comprises a ring groove that extends through the planar ring into the opening, wherein the ring groove forms a tab groove as a tab groove portion of the ring groove extends towards the opening and wherein the tab groove portion of the ring groove has the same height, angle and width as the other inner tab grooves with respect to the planar ring; and wherein the planar ring further comprises a first end and a second end adjacent to the ring groove, wherein the first end of the planar ring and the second end of the planar ring comprises a ring hole.

2. The method of claim 1, wherein the alloy is a pre-tinned C-510 phosphor bronze alloy.

3. The method of claim 1, wherein the inner tabs are curved to extend upwardly from the planar ring.

4. The method of claim 3, wherein a tab groove is positioned between each inner tab.

5. The method of claim 4, wherein the inner tabs have a width which narrows as it extends inwardly.

6. The method of claim 5, wherein all of the inner tabs and tab grooves have the same size and shape.

7. The method of claim 6, wherein the retaining ring terminal comprises eight inner tabs.

8. The method of claim 1, wherein the female post connector portion is connected to the cable connector portion by a first bridge portion.

9. The method of claim 8, wherein the cable connector portion of the retaining ring terminal comprises one or more sets of flanges which can be crimped to electrically connect the retaining ring terminal to a cable.

10. The method of claim 9, wherein the cable connector portion comprises a first flange set, a second flange set and a second flange bridge portion connecting the first flange set to the second flange set, wherein the first flange set and the second flange set comprise an inner surface, an outer surface, a first flange end, a second flange end and wherein the second flange set comprises an end surface edge forming a first end of the retaining ring terminal.

11. The method of claim 10, wherein the first flange end of the first and second flange sets each comprise a first flange edge surface, wherein the second flange end of the first and second flange sets each comprise a second flange edge surface and wherein the first flange edge surface and the second flange edge surface come into contact with each other when the first and second flange sets are crimped together.

12. The method of claim 11, wherein the first flange set has a length which is greater than the length of the second flange set when the first flange set and the second flange set are in an opened state and wherein the second flange set has a width which is greater than the first flange set when the first flange set and the second flange set are in an opened state.

13. The method of claim 12, wherein the first flange set is adjacent to the first bridge portion connecting the female post connector portion.

14. The method of claim 13, wherein the second flange set is adjacent to the second flange bridge portion connecting the first flange set.

15. The method of claim 14, wherein the second flange bridge portion comprises a first end proximate to the first flange set and a second end proximate to the second flange set, wherein the first end of the second flange bridge portion has a width that is less than that of the second end of the second flange bridge portion when in an opened state.

16. The method of claim 15, wherein the ratio of the length to the combined length of the first flange set, second flange set and second flange bridge portion is not more than 3.5:1.

17. The method of claim 16, wherein the ratio of the length to the first flange set is not more than 6:1.

18. The method of claim 17, wherein the ratio of the length to the second flange set is at least 10:1.

19. The method of claim 15, wherein the first flange set comprises one or more ribs along its inner and outer surface.

20. The method of claim 1, wherein the ratio of the diameter of the retaining ring to the diameter of the opening is at least 2.6 but not more than 3.1.

* * * * *